US005669373A

United States Patent [19]

Gulddal

[11] Patent Number: 5,669,373

[45] Date of Patent: Sep. 23, 1997

[54] THERMOSTATIC REGULATED AIR FLOW CONTROLLER

[76] Inventor: Bjørn Kamp Gulddal, Lindholmsvej 47, DK 2700 Brønshoj, Denmark

[21] Appl. No.: 505,308

[22] PCT Filed: Feb. 18, 1994

[86] PCT No.: PCT/DK94/00070

§ 371 Date: Dec. 12, 1995

§ 102(e) Date: Dec. 12, 1995

[87] PCT Pub. No.: WO94/19635

PCT Pub. Date: Sep. 1, 1994

[30] Foreign Application Priority Data

Feb. 18, 1993 [DK] Denmark ..... 0187/93

[51] Int. Cl.[6] ..... F24H 3/00

[52] U.S. Cl. ..... 126/112; 126/77; 126/290; 236/96

[58] Field of Search ..... 126/285 B, 77, 126/293, 112, 110, 290, 285 R, 289; 236/96; 237/51

[56] References Cited

U.S. PATENT DOCUMENTS 2,164,417 7/1939 McKee .
2,948,276 8/1960 Harding ..... 236/96
3,168,088 2/1965 Martin et al. ..... 236/96
4,180,051 12/1979 Maier et al. ..... 236/96
4,629,114 12/1986 Baker ..... 126/112

FOREIGN PATENT DOCUMENTS 683492 11/1939 Germany .

*Primary Examiner*—James C. Yeung
*Attorney, Agent, or Firm*—Bell, Seltzer, Park & Gibson

[57] ABSTRACT

The invention concerns a thermostatic air flow controller. Such flow controllers may be specially useful for controlling the intake of air to a heating stove. The controller has a main air passage with a set of matching register plates which may open or close the passage according to the influence from a temperature sensing element, which is placed in a secondary air passage. The controller according to the invention has this temperature sensing element placed close to the register plates and between those plates and a heat shield which guards the temperature sensing element from the influence of the temperature in the air receiving vessel. This configuration admits a very compact construction which is specially useful for mounting the flow controller on the intake opening of a heating stove.

10 Claims, 3 Drawing Sheets

THERMOSTATIC REGULATED AIR FLOW CONTROLLER

FIELD OF THE INVENTION

The invention relates to thermostatic air flow controllers.

BACKGROUND OF THE INVENTION

The invention relates to a thermostatic air flow controller which has a main passage for air from a source of air to a receiving vessel, for instance the interior of a heating stove, and in which main air passage register plates with matching openings are placed in such a way that it is possible to adjust the area of the passage through the register plates by moving one of the register plates respective to the other plate. The adjustable register plate is connected to a temperature sensing element, which is placed in a secondary air passage, in such a way that the temperature of the secondary air flow will influence the sensor element, which then through said connection adjusts the openings for the main air flow.

Air flow controllers of this type make it possible to regulate a flow of air according to the temperature of the incoming air. Such controllers may find a use in connection with ventilation systems and similar systems, but the most obvious application is in connection with heating stoves. Such stoves generally have an air inlet admitting air from the room to be heated into the stove to supply the fire in the stove.

An air flow controller of this type is known for instance from the specification of German patent nr. 683492, which shows an air flow controller with a main air passage in which is placed a set of register plates which regulate the flow through the controller by angular movement of one plate in relation to the other plate. The air flow controller is meant to be connected to a side wall of a heating stove in such a way that the air flow may nourish the fire in the stove. Furthermore this flow controller has a secondary air passage which also leads to the interior of the stove, and in which secondary passage is placed a temperature sensing element which is connected to the movable register plate.

The secondary air passage is arranged as a special housing placed on the side of the housing for the main air passage. This arrangement necessitates the use of a rather great number of parts which have to be assembled to form the controller.

It is an object of the invention to indicate a simpler and more compact arrangement of an air flow controller of this type, which controller consists of fewer parts than the previously known controllers and provides a simpler and more reliable connection between the thermostatic element and the movable register plate.

SUMMARY OF THE INVENTION

This has been achieved according to the invention by a construction in which the temperature sensing element is placed close to the register plates and between those plates and a heat shield in such a way that the temperature sensing element is shielded from the influence of the temperature in the receiving vessel, and that the two passages for air flow unite in the area surrounding the temperature sensing element in such a way that they will sweep the surfaces of the heat shield and cool the shield.

Compared to the construction according to the above mentioned German patent specification the air flow controller according to the invention may be assembled from considerably fewer parts and may be designed as a more compact unit. By placing the temperature sensing element close to the register plates a much more reliable connection between the element and the movable register plate may be achieved.

Furthermore the position of the temperature sensing element close to the junction of the two air flow passages ensures a reliable dependence of the element on the temperature of the incoming air without any interference from any other heat source.

A special embodiment of the air flow controller according to the invention is characterised in that a second set of register plates are placed across the secondary air passage in such a way that the air flow through said secondary air passage may be manually adjusted.

The secondary air passage admits air to the receiving vessel even when the main air flow is completely shut off by the first set of register plates. Placing register plates in the secondary passage makes it possible to manually adjust this stand-by air flow according to need.

In a further embodiment according to the invention the air flow controller consists of a cylindrical hollow base member which may be connected to the air flow receiving vessel, and which supports a lid member with a front plate which forms the first register plate and is provided with a number of radial openings. A circular adjustable register plate is positioned adjacent to the front plate and has matching openings so that these openings form the entrance to the main air passage while other openings in the lid member form the entrance to the secondary air passage. A temperature sensing element is placed coaxially to the base member and between the plane of the register plates and a heat shield which is supported by the base member. The construction is such that the two air passages unite in the area around the heat shield and are able to sweep the heat shield and thereby cool said heat shield.

The secondary air passage may in this embodiment of the air flow controller consist of openings in the register plates, either central or peripheral, which openings are placed in such a way that an air flow may pass through these openings and directly past the temperature sensing element. The element is connected in such a way to the movable register plate that it may open and close the matching openings in the register plates in accordance with the temperature of the air flow around the element.

This construction of the thermostatic air flow controller is specially suitable for controlling the intake of air to a heating stove. It makes a very compact design possible and it will be very easy to mount on an existing stove. The temperature of the ambient air which passes through the controller plates influences through the temperature sensing element—which conveniently may consist of a bimetallic spiral element—the free area of the openings through the matching register plates. Thereby the intensity of fuel burning in the stove and the heat emitted from the stove is regulated in such a way that the temperature of the ambient air may be kept constant within narrow limits.

The combined flow through the air flow passages, which influences the working of the temperature sensing element, will control the temperature of the ambient air and no other heat source will influence said element.

The above mentioned embodiment of the air flow controller according to the invention may further be characterised in that the lid member is mounted in such a way on the base member that it may be turned through an angle in relation to the base member.

This arrangement makes an adjustment of the controller very easy. By turning the lid member a slight angle in one direction or other the rate of flow through the openings in the register plates will be adjusted, and a new setting for the desired temperature of the ambient air will be achieved.

The above mentioned embodiment of the invention may furthermore be characterised in that a second set of register plates are placed the across central parts of the main register plates in such a way that the passage through said second set of register plates may be manually adjusted.

When the air flow controller is used in connection with a heating stove this second set of register plates makes it possible to adjust the air flow which remains when the main air passage is closed. A desired low stand-by rate of burning in the stove may be secured in this way even when the main register plates have completely closed down the main air flow. A very simple and lightweight construction is achieved by placing the second set of register plates in the central parts of the main register plates.

In the embodiment of the controller according to the invention in which as above mentioned the lid member is cylindrical and therefore the front plate is circular. The front plate may according to the invention consist of two areas of which the outer area contains the openings of the main air passage's outer register plate, while the central area contains the openings of the secondary air passage's inner register plate.

This design of the front plate makes the front plate as such serve both as the outer register plate for the main air flow and as the inner register plate for the secondary air flow, whereby a very simple and inexpensive design is achieved.

An air flow controller of the kind mentioned above may also be characterised in that a temperature sensing element is mounted on the bottom part of the base plate in such a way that it may be influenced by the temperature in the air receiving vessel. An arm is mounted on an axle on the inside of the bottom Dart of the base plate and connected to the temperature sensor through an adjusting screw in such a way that an increase in the temperature in the air receiving vessel makes this temperature sensor force the arm to swing through a small angle in the direction away from the bottom plate. The arm has a curved shape with an end part which is close to the adjustable main register plate, and furthermore a crank lever is mounted on the inner side of the front plate of the lid member and connected in such a way to the adjustable register plate that a movement of said arm in the direction towards the front plate results in an angular movement of the adjustable register plate towards the closing of the openings in the register plates.

This arrangement makes it possible to achieve an automatic adjustment of the main adjustable register plate in case the temperature inside the air flow receiving vessel reaches an unacceptable level. If this happens the temperature sensor will force the arm outwards towards the front plate of the lid member and the outer end of this arm will press against the crank lever in such a way that the adjustable register plate will move towards closing the openings in the register plates, whereby the air flow to the receiving vessel will be diminished. If this vessel is the interior of a heating stove the combustion in the stove will automatically slow down and the temperature will be lowered.

A special embodiment of the controller according to the invention is characterised in that a slanting cam is connected to the inner side of the adjustable register plate of the main air passage. A locking screw is mounted in the lid member in such a way that by contact with said cam may stop the movement of the register plate. This locking screw by being screwed more or less deeply into the lid member to determine the point at which the register plate may be stopped.

This makes it possible to determine a desired minimum or maximum closing position of the register plates for the main air flow. By turning the above mentioned locking screw it is possible to choose the position at which further movement of the adjustable register plate should be prevented.

A somewhat different embodiment of the air flow controller according to the invention may be characterised in that the air flow controller consists of a cylindrical hollow base member which may be connected to the air flow receiving vessel. A lid member with a front plate which forms the first register plate is provided with a number of openings, while a circular adjustable register plate is positioned adjacent to the front plate and has matching openings so that these openings form the entrance to the main air passage. The lid member has a second set of openings in a side part which cover the outside of the base part, which second set of openings in the lid member form the entrance of the secondary air passage. A second cylindrical register plate with matching openings is placed adjacent to the inside of the lid member in such a way that it may be turned a desired angle by means of a handle protruding through a slit in the lid member. The air flow controller further has a temperature sensing element just inside the lid member and placed along the inner wall of the lid member in such a way that the combined air flows from the air passages may sweep the temperature sensor and cool it, which temperature sensor is connected to the adjustable register plate. An annular heat shield is supported on the inner wall of the base member in such a way that the temperature sensor is shielded from the influence of the temperature in the air flow receiving vessel.

This construction is different from the above mentioned construction with cylindrical base and lid members in that the temperature sensor here is placed along the inner wall of the lid member. It is hereby possible to attain a very efficient cooling of the temperature sensor and by proper dimensioning of the annular heat shield it is also possible to shield the temperature sensor very effectively against heat radiation from the interior of the air flow receiving vessel.

In a different embodiment of the air flow controller according to the invention the controller may consist of a rectangular base member which may be connected to the air flow receiving vessel, and upon which base member a lid member is slidably supported. The lid member has a front plate which forms the first register plate and has openings which match openings in a second register plate which is able to slide in relation to the first register plate in such a way that the area of the passage through the openings may be adjusted. The second register plate is connected to a temperature sensing element placed in a secondary air passage close to the register plates in such a way that the temperature in this secondary passage may influence the temperature sensing element and thereby change the setting of the second register plate, and which temperature sensing element furthermore is shielded by a heat shield connected to the base member.

This embodiment of the invention represents a possible different arrangement of the air flow controller according to the invention. The use of sliding elements for regulating the air flow allows a more robust dimensioning of the individual parts of the air flow controller.

BRIEF DESCRIPTION OF THE DRAWINGS

The invention is to be explained in more detail with reference to the drawings in which.

DETAILED DESCRIPTION OF THE PREFERRED EMBODIMENTS

Figure 1A:
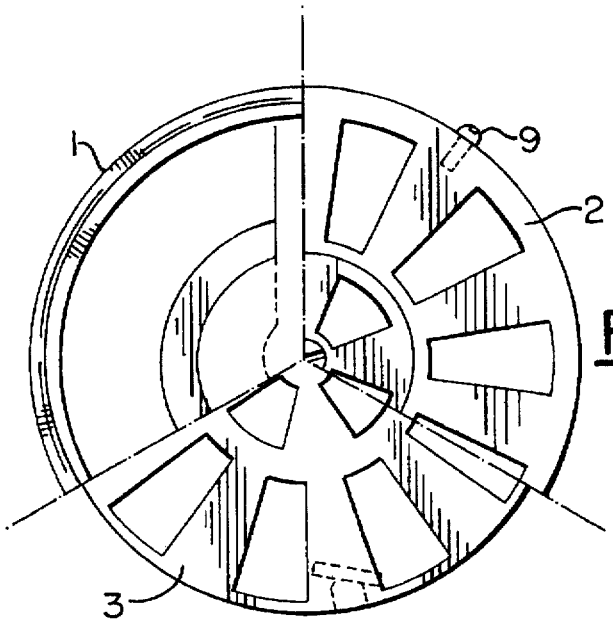
FIG. 1*a* is a front view of the air flow controller according to the invention.
Figure 1B:
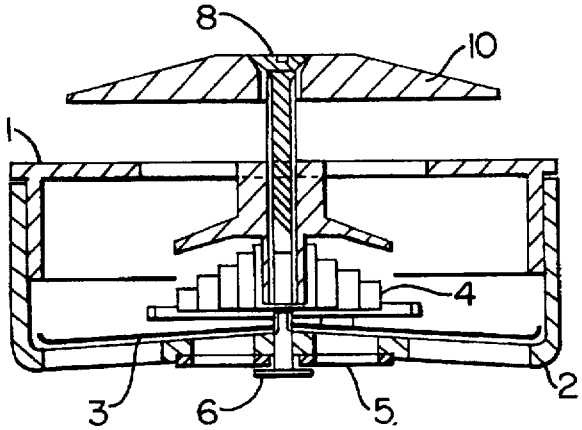
FIG. 1*b* is a section of the air flow controller.

The air flow controller shown in FIGS. 1A and 1B consists mainly of a base member 1 and a lid member 2. The lid member has a front plate with a number of radial slits, which front plate comprises one of a pair of register places. The other register plate 3 is supported coaxially with the front place and has matching axial slits. By moving the second register plate 3 through an angle it is possible to regulate the area of the passage through the slits.

The base member 1 may be connected to an opening leading to an air receiving vessel, for instance a heating stove. The passage through the slits and through the interior of the lid member 2 and the base member 1 constitutes a main air passage from a source of air to the air receiving vessel. A temperature sensing coil 4 is placed coaxially with the base member and the lid member, and close inside the register plates. This temperature sensor 4 is connected to the second register plate 3 in such a way chat an increase in the temperature of the air surrounding the temperature sensor 4 results in a closing of the matching slits and vice versa.

The base member 1 supports a coaxial heat shield 7 which is able to shield the temperature sensor 4 from the heat emanating from the vessel receiving the air flow. The lid member 2 is equipped with radial slits in an area close to the centre in such a way that it together with a register plate 5 with matching slits forms a set of minimum air passage register plates.

This arrangement forms a secondary air passage through said matching slits, past the temperature sensor 4 and around the heat shield 7. The secondary air passage may admit air to the air flow receiving vessel as a stand-by flow when the openings in the main register plates are closed. But chiefly the secondary air passage supplies a flow of air the temperature of which influences the temperature sensor 4 and thereby directs the opening and closing of the slits in the main register plates.

As shown in FIG. 1B the register plate 5 for the secondary air passage is kept in place by an axle 6. By manually turning the register plate 5 the desired minimum air flow may be adjusted.

The lid member 2 is held in place on the base member 1 by means of a locking screw 9 which passes through the wall of the lid member and enters an annular groove in the outer wall of the base member. This enables the lid member 2 to be rotated on the base member 1 but prevents an inadvertent removal of the lid member 2.

The locking screws may be positioned in such a way that it may serve as a marker to indicate the desired temperature by comparing it to a mark on the base member 1 when the lid member 2 is turned in relation to the base member.

The front plate of the lid member 2 consists in this embodiment of two areas of which the outer area contains the openings of the main air passage's outer register plate, while the central area may be slightly depressed, and it contains the openings of the secondary air passage's inner register plate. The adjustable secondary register plate 5 is mounted on the outside of the front plane, for instance in such a way that it fits into the central depression of the front plate. This front plate may further be shaped slightly conical so that the central area protrudes a small distance inward in relation to the outer area of the front plate. The adjustable inner register plate 3 in this case has a matching conical shape, which makes it somewhat more sturdy. Because the adjustable register plate (3) conveniently is made of very thin material, this is an advantage when the plate has to be handled.

The air flow controller according to the invention is mainly useful as an air flow controller for a heating stove. The controller may be connected to an air intake opening of an existing heating stove, which intake opening may have a crossbar 10 for mounting a set of register plates for manual adjustment of the air intake. After these register plates for manual control have been removed, the controller may be mounted on the stove by means of a single bolt 8 which passes through the crossbar 10 and is fastened centrally in the base member 1. An annular insulation disk may be placed between the base member 1 and the outer surface of the heating stove.

In the shown embodiment of the controller according to the invention the lid member 2 is mounted on the base member 1 in such a way that it may be turned a certain angle in relation to the base member 1. This arrangement makes it possible to adjust the desired temperature which the temperature sensing element will determine. The head of the above mentioned locking screw may serve as indicator marks for the setting of the lid member 2 in relation to the base member 1 which determines the desired temperature of the ambient air.

When the controller according to the invention is mounted on a heating stove in the described way the temperature secondary air flow which passes over the temperature sensor will determine the degree of opening of the matching slits in the main air flow. As long as the air temperature in the room is below the desired value the slits will remain open, but when this temperature gets close to the desired value the temperature sensor will start closing the openings.

This results in a decrease of the air intake to the stove which will then burn lower. Thereby the stove will emit less heat energy to the room and the room temperature will tend to remain constant at the desired value.

All internal surfaces of the controller will be swept by the combined airflows which are entering through the main and the secondary air passage.

It may be convenient to be able to determine a certain minimum or maximum position for the movement of the adjustable register plate 3. The plate may therefore be provided with a cam which is slanted at an angle to the periphery of the plate. A locking screw 9 is mounted in the wall of the lid member 2 at an appropriate point. When the register plate 3 is turned through the influence of the temperature sensor 4 the cam will come to rest at the locking screw. By turning the screw inwards or outwards this exact position may be determined.

The controller according to the invention may be provided with a mechanism for direct control of the temperature inside the air flow receiving vessel, for instance the interior of a heating stove. To this purpose the bottom of the base part 1 is provided with a temperature sensing element T which is mounted in such a way that it will be influenced by the temperature of the air receiving vessel, normally the inside of a heating stove. A curved arm B is mounted on an axle A in such a way that when the temperature in the heating stove increases the sensor element will turn the arm B inwards towards the lid member. A crank lever V is mounted on the inner side of the lid member in such a way that the movement of the curved end of the arm B towards the front plate will force the crank lever V to turn through an angle. The crank lever is connected to the adjustable register plate in such a way that the pressure from the curved arm B will move the adjustable register plate towards closing.

The curved arm B has no direct connection to the crank lever V so that this lever may move freely with the movement of the register plate, but when the temperature of the interior of the heating stove increases beyond a fixed level the movement of the temperature sensor T tends to close the register plates and thereby lower the combustion rate of the stove. An adjusting screw J is mounted on the temperature sensor T in such a way that the setting of the arm B may be adjusted manually for determining the temperature level of the interior of the stove at which the closing of the resister plates is to begin.

Figure 2A:
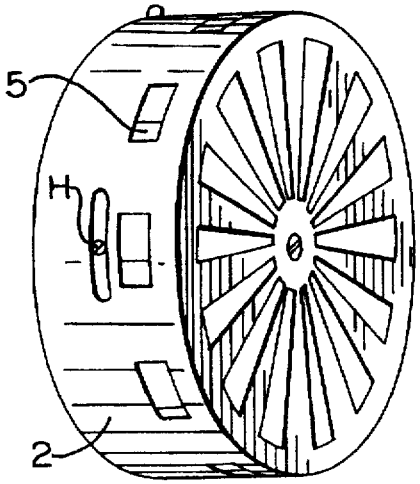
FIG. 2*a* shows in perspective another version of the controller according to the invention.
Figure 2B:
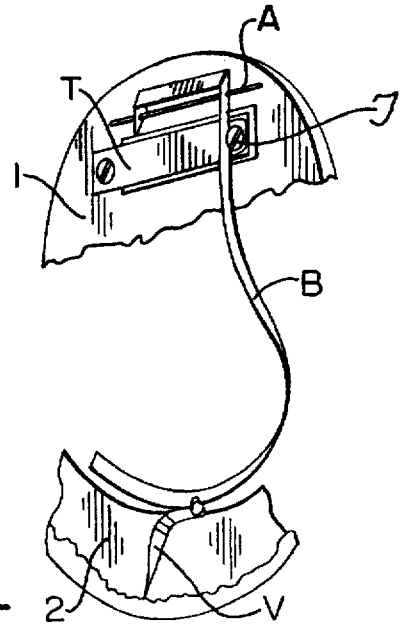
FIG. 2*b* shows a mechanism for adjusting the setting of the main register plates in accordance with the temperature on the back side of the base plate.

FIG. 2*a* is a view in perspective of the outside of a different design of the air flow controller according to the invention. The lid member 2 is shown having an outer rim which covers the base member, and which rim is provided with circumferentially placed openings constituting the entrance of the above mentioned secondary air passage while, a secondary register plate 5 with matching openings is placed just inside said rim. In this embodiment an annular temperature sensing element is mounted just inside the above mentioned openings. A handle H is connected to the inside register plate and protrudes through a slit in the rim of the lid member 2.

By manually moving the handle H it is possible to adjust the desired rate of flow through the secondary air flow passage. As mentioned above the annular temperature sensing element will be placed along the circumference of the rim of the lid member. Thereby the air flows from both passages will sweep the temperature sensor in a very efficient way.

The necessary heat shield will in this embodiment consist of an annular flange on the base member with a sufficient width to prevent heat radiation from the interior of the stove to reach the temperature sensor.

Figure 3A:
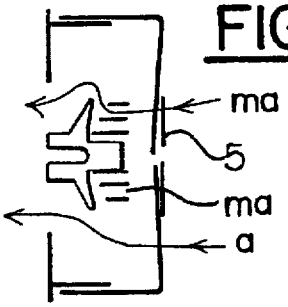
FIG. 3*a* and 3*b* show different flow directions for the air.
Figure 3B:
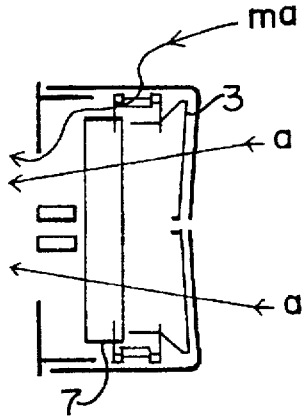

FIG. 3*a* and 3*b* schematically show sections of two different embodiments of the control according to the invention. FIG. 3*a* shows the passage of the arriving air flow through an embodiment of the kind depicted in FIG. 1*b*. The arrow a shows the main air flow, which passes through the outer matching openings when these are open, while the arrow ma shows the secondary air flow through the secondary openings, which are placed closer to the central axis 5 for the register plates.

In FIG. 3*a* it is shown how the secondary air stream passes the centrally placed matching openings and after that flows around the temperature sensor 4, which is placed directly inside of the register plate, before it mixes with the main air flow a.

FIG. 3*b* shows a construction where the secondary air stream passes openings in the side of the lid part and thereafter directly flows around the temperature sensor 4 before it mixes with the main air flow a, which passes straight through the central part of the air flow controller.

Figure 3C:
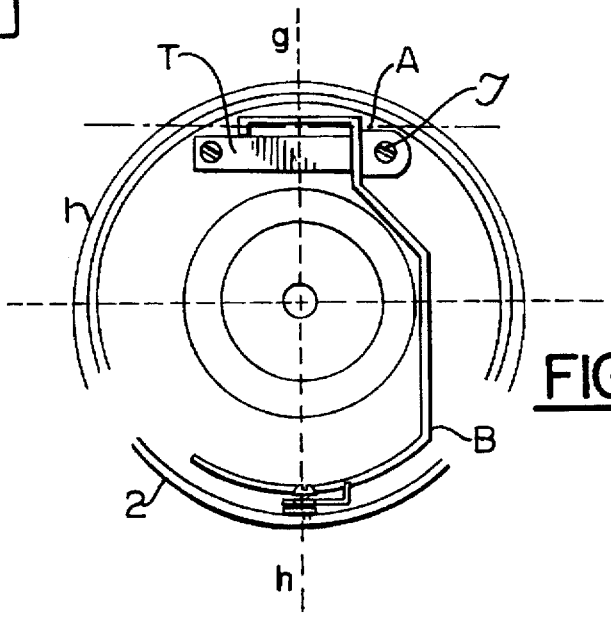
FIG. 3*c*, 3*d*, 3*e* are sectional views of a mechanism for regulating of the main register in relation to the temperature by the backside of the basepart.

FIG. 3*c* is a front view of a embodiment of the controller according to the invention in which a temperature sensor T is placed on the base part in such a way that it may react to the temperature inside the air flow receiving unit. The sensor T influences an arm B through an adjusting screw, which arm B then may influence the movement of the register plate 3 for the main air stream. This makes it possible to shut down the main air stream if the temperature in the air flow receiving unit becomes too high.

Figure 3D:
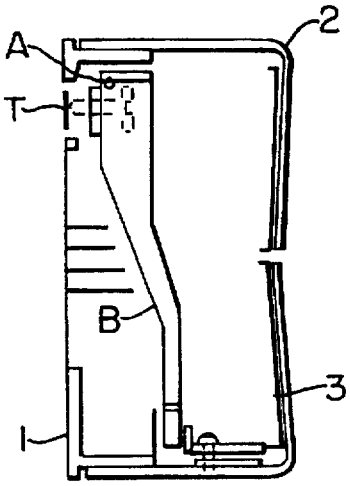

FIG. 3*d* is a section along the line g–h through this construction.

Figure 3E:
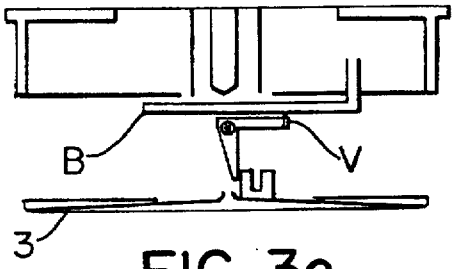

FIG. 3*e* shows another section, in which is shown a bell crank lever V which is supported on the lid part 2 in such a way that a movement of the arm B will produce a turning of the lever V. This turning of the lever V will again produce a closing of the register plate 3 for the main air flow. The lever V is supported on the inner wall of the lid part 3.

Figure 4A:
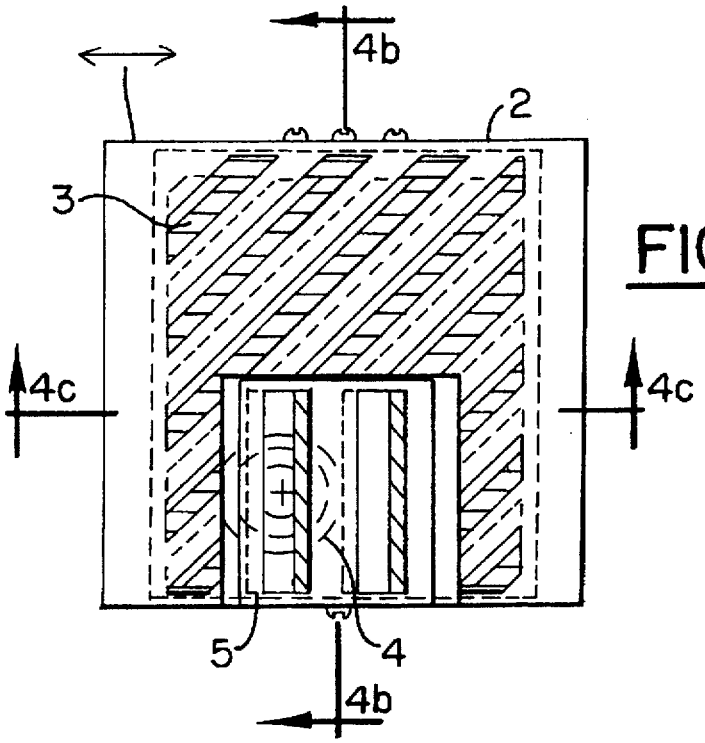
FIG. 4*a*, 4*b*, 4*c* are sectional views of an arrangement of the regulator, which has a rectangular form.
Figure 4B:
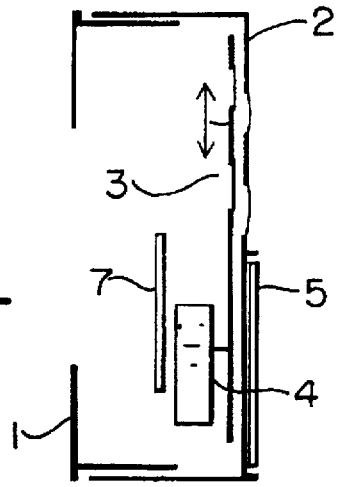
Figure 4C:
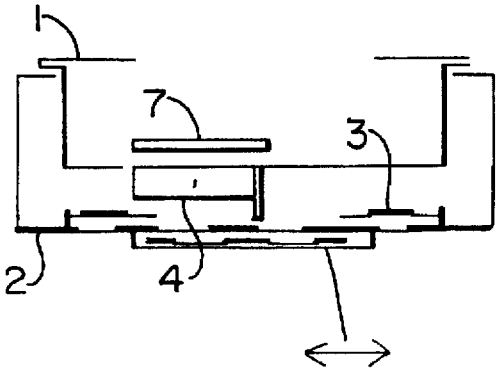

FIGS. 4*a*–4*c* are three sections of a different embodiment of the controller according to the invention. As shown in FIG. 4*a* the controller has a rectangular basical shape, but in this embodiment the lid part 2 extends to a greater length in the horizontal direction than the base part 1. The lid part may be displaced horizontal in relation to the base part 1. The lid part is provided with slanting openings and directly inside these slits is placed a register plate 3 with matching openings. These matching openings form the main air stream passage.

Furthermore the lid part is provided with a set of vertical openings which matches openings in a register plate 5 for the secondary air stream. The temperature sensor 4 is placed in the area through which the secondary air flow passes, which sensor is connected to the register plate 3 for the main air flow. The temperature sensor 4 is shielded by a heat shield 7 from the heat radiating from the air receiving unit.

FIG. 4*b* is a section along the line A—A in FIG. 4*a*, and FIG. 4*c* is a section along the line B—B in FIG. 4*a*. In this embodiment of the controller the position of the movable register plate 3 is regulated in the same way as in the previously mentioned embodiments by the temperature of the secondary air flow which is identical with the temperature of the ambient air.

The lid part is slidable in relation to the base part in a horizontal direction, whereby it is possible to adjust the air flow through the controller. If the controller is connected to a wood burning stove, it is possible to regulate the temperature of the ambient air with great accuracy.

Although only a few specific forms of the controller according to the invention have been described above, it will be understood that various modifications may be made without departing from the concept indicated in the claims.

I claim:

1. A thermostatic air flow controller for controlling the air flow from a source of air to a heated receiving vessel in response to temperature changes of the air flow, said controller comprising:

a plurality of air passage register plates supported between the source of air and the receiving vessel, at least one of said register plates being movably supported relative to the others, said register plates defining corresponding openings which can be aligned to open a main air passage and which can be realigned to constrict the area of the main air passage and the air flow therethrough, at least one of said register plates also defining a secondary air passage between the air source and the receiving vessel;

a temperature sensing element mounted in said secondary air passage such that the temperature of the secondary air flow through said secondary air passage will be sensed by said temperature sensing element, said temperature sensing element mounted adjacent to and in operative connection with said movable register plate to constrict said main air passage in response to an increase in the temperature of the air flow through said secondary air passage; and a heat shield between said temperature sensing element and the heated receiving vessel for shielding said sensing element from the heat of the receiving vessel, said main and secondary air passages uniting in the area surrounding said temperature sensing element such that the flow of air sweeps the surfaces of said heat shield and cools said heat shield.

2. A thermostatic air flow controller according to claim 1 further comprising at least one secondary register plate mounted over the secondary air passage such that the air flow through said secondary air passage can be manually adjusted.

3. A thermostatic air flow controller according to claim 1 wherein said air flow controller further comprises:

a cylindrical hollow base member connected to the air flow receiving vessel and defining a central axis, said heat shield being supported on said base member;

a lid member mounted to said hollow base member and having a substantially planar front register plate which defines a first plurality of openings for the main air passage and a second plurality of openings for the secondary air passage; and a circular adjustable register plate supported in a face-to-face relationship with said front register plate and defining a plurality of openings corresponding to the openings in said front plate, said temperature sensing element being mounted along the axis of the base member and between the plane defined by said front plate and said heat shield.

4. A thermostatic air flow controller according to claim 3 wherein said lid member is rotatably mounted on said base member such that said lid member can be turned through an angle in relation to the base member.

5. A thermostatic air flow controller according to claim 3 further comprising at least one secondary register plate mounted over the secondary plurality of openings such that the air flow through said secondary air passage can be manually adjusted.

6. A thermostatic air flow controller according to claim 3 wherein said second plurality of openings in said front plate are radially interior of said first plurality of openings.

7. A thermostatic air flow controller according to claim 3 further comprising:

a second temperature sensing element mounted on said base member to sense the temperature of the air receiving vessel;

an arm pivotally mounted on said base member and operatively connected to the second temperature sensing element for limited movement in response to an increase in temperature of the air receiving vessel, said arm having an end portion; and a crank lever mounted on the inner side of said lid member and movable by said end portion of said arm, said crank lever structured to engage said movable register plate and override the operation of said first temperature sensing element to constrict said main air passage.

8. A thermostatic air flow controller according to claim 3 further comprising:

a slanting cam connected to said movable register plate of the main air passage; and a locking screw mounted in the lid member such that contact with said cam stops the movement of said movable register plate, said locking screw being movable in and out of said lid member to determine the point at which said movable register plate is stopped.

9. A thermostatic air flow controller according to claim 1 wherein said air flow controller further comprises:

a cylindrical hollow base member connected to the air flow receiving vessel and defining a central axis, said heat shield being supported on said base member;

a lid member mounted over said hollow base member and having a substantially planar front register plate which defines a first plurality of openings for the main air passage, said lid member defining a second plurality of openings in a side wall thereof for the secondary air passage;

a circular adjustable register plate supported in a face-to-face relationship with said front register plate and defining a plurality of openings corresponding to the openings in said front plate;

a cylindrical register plate mounted coaxially inside of said lid member and defining openings in a side wall of said cylindrical register plate corresponding to said second plurality of openings the side wall of said lid member; and a handle connected to said cylindrical register plate and protruding through a slit in said lid member for manual adjustment of said cylindrical register plate, wherein said temperature sensing element is positioned inside the lid member in an annular arrangement adjacent the side wall of the lid member such that the main and secondary air flows from the air passages sweep the temperature sensor.

10. A thermostatic air flow controller according to claim 1 wherein said controller further comprises:

a rectangular base member connected to the air flow receiving vessel, said heat shield being supported on said base member;

a lid member slidably supported on said base member and having a first register plate defining a plurality of openings; and a second register plate slidably supported in relation to the first register plate and defining a plurality of openings corresponding to the openings in said first register plate.

* * * * *